United States Patent [19]

Menzi

[11] 3,939,955

[45] Feb. 24, 1976

[54] MECHANISM FOR SELECTIVELY CONTROLLING AT LEAST TWO FUNCTIONS IN A TYPEWRITER

[75] Inventor: Ulrich Menzi, Yverdon, Switzerland

[73] Assignee: Paillard S.A., Sainte-Croix, Switzerland

[22] Filed: May 1, 1974

[21] Appl. No.: 465,850

[30] Foreign Application Priority Data

May 8, 1973 Switzerland ..... 6503/73

[52] U.S. Cl. ..... 197/17; 197/65; 197/114 R

[51] Int. Cl.[2] B41J 21/08; B41J 25/02; B41J 25/04; B41J 25/06

[58] Field of Search ..... 197/17, 65, 66, 67, 68, 197/91, 114 R, 120

[56] References Cited

UNITED STATES PATENTS

| | | | |
|---|---|---|---|
| 3,268,049 | 8/1966 | Krauss et al. | 197/17 |
| 3,338,368 | 8/1967 | Salto | 197/65 X |
| 3,759,361 | 9/1973 | Link | 197/120 X |

*Primary Examiner*—Edgar S. Burr
*Assistant Examiner*—Paul J. Hirsch
*Attorney, Agent, or Firm*—Emory L. Groff, Jr.

[57] ABSTRACT

A mechanism for controlling functions such as step-by-step carriage return, line spacing and rapid carriage return in a typewriter comprises a single cam adapted to oscillate a single actuating member. The actuating member carries a selector which can be positioned to selectively actuate levers controlling the various functions. The selector is positioned by a single lever which is tilted by different amounts by sliding bars each associated with a key corresponding to a given function. In its rest position, said lever locks the actuating member with the cam disengaged from a driving roller.

9 Claims, 7 Drawing Figures

MECHANISM FOR SELECTIVELY CONTROLLING AT LEAST TWO FUNCTIONS IN A TYPEWRITER

The invention relates to a mechanism for controlling at least two functions in a typewriter, namely a typewriter with a printing head, comprising a driving member, and a carriage carrying said printing head and being movable in front of a fixed platen adapted to receive a sheet of paper or the like.

Various known mechanisms are used in this kind of typewriter to control various functions such as the step-by-step return of the carriage, line spacing, and rapid return of the carriage. These known mechanisms are complicated and bulky since they require many parts for the control of each function.

An object of the invention is to provide a simple mechanism of reduced bulk for the control of said functions, and the parts of which make very few movements. This object is achieved by the mechanism according to the invention which comprises a single cam acting on a member for actuating control levers provided for each of said functions, a selector being carried by said actuating member for selectively coupling the latter to the control lever of the selected function.

The accompanying drawing shows, schematically and by way of example, an embodiment of the invention. In the drawing.

The mechanism shown is for the control of three functions: step-by-step carriage return, line spacing, and full carriage return.

Figure 1:
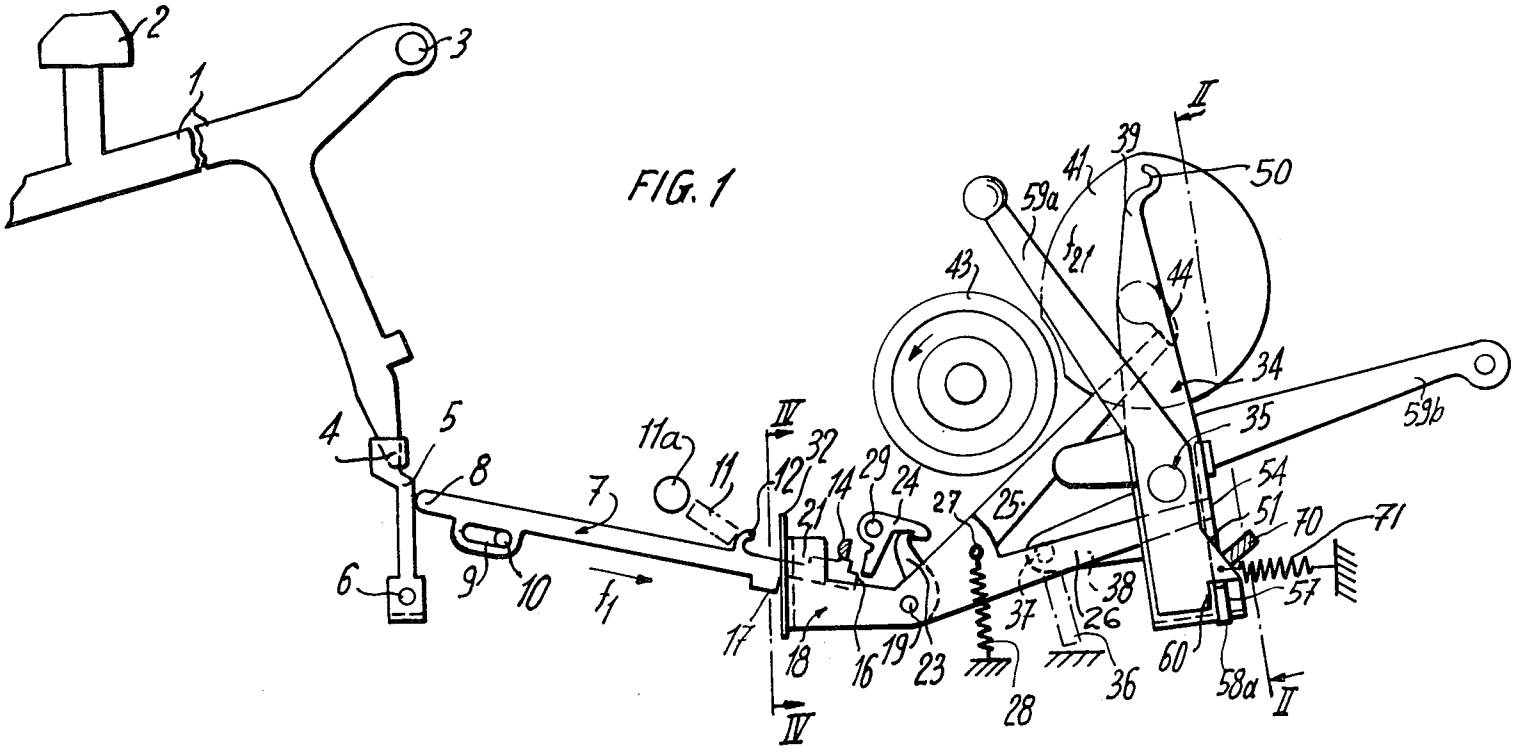
FIG. 1 is an overall side view of the mechanism.

FIG. 1 shows only the parts of the typewriter necessary for an understanding of the invention, to the exclusion of well known parts such as a fixed frame, keyboard, writing head carriage, and devices for performing the three stated functions, which may all be of conventional construction.

The mechanism for controlling these three functions is actuated by three levers 1, only one of which is shown in FIG. 1, each carrying a key 2 disposed on the keyboard. Each lever 1 is pivotally mounted about a rod 3 fixed to the frame, and is guided and biased by any known means, not shown. An end 4 of each lever 1 cooperates with an intermediate lever 5 pivoted about a rod 6. A rear end 8 of a sliding lever or bar 7 bears against each lever 5.

In the example shown, the device comprises three different sliding bars 7 actuated by respective ones of the three levers 1 for controlling the stated three functions, only one of these levers 7 being shown in FIG. 1.

Each lever or bar 7 is formed of hard steel and is capable of sliding longitudinally by means of a slot 9 in which a rod 10 fixed to the frame is engaged. A spring 11, attached at one end to a hook 12 disposed towards the front end of bar 7 and attached at its other end to a rod 11*a* connected to the frame, tends to oppose forward longitudinal movement of the bar 7 and also tends to pivot the forward end of bar 7 upwards about rod 10.

Figure 5:
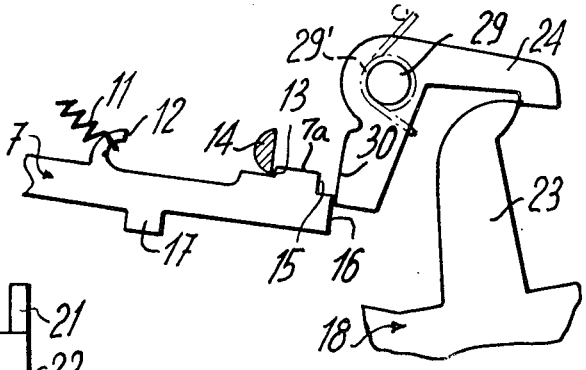
FIG. 5 is a view of a detail in FIG. 1.

On the upper part of each bar 7 towards its front end is a projection 7*a* forming a vertical step 13 (FIG. 5) adapted to bear against the flat face of a semi-cylindrical stop 14 fixed to the frame. The said projection 7*a* also forms a second vertical step 15 just behind the front face 16 of the bar 7. The lower part of each bar 7 has a protuberance 17 with a height *a*, *b* or *c* (see FIG. 6) different from one bar 7 to another.

A selector lever 18 pivotally mounted about a rod 19 has two forwardly-extending arms 25 and 26 disposed at an acute angle to one another. Lever 18 is biased to tend to pivot in the clockwise direction about rod 19 by a spring 28 fixed at one end to lever 18 at 27 and at its other end to the frame. The lower, rear part of lever 18 has, in plan view, a generally U-shaped stirrup with two upwardly extending unequal arms 20 and 21 joined by a web 22 (see FIG. 4). The main part of said lever 18 in the plane of arm 21 has a beak 23 able to cooperate with a catch 24 pivoted about a rod 29. A biasing spring 29', FIG. 5, acts on catch 24 to tend to turn it in the clockwise direction. The catch 24 can be actuated by the front face 16 of any bar 7 which can bear on an abutment face 30 of the catch 24.

Figure 4:
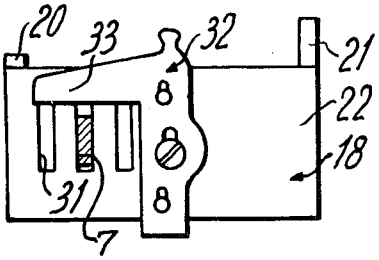
FIG. 4 is an enlarged-scale view along line IV—IV of FIG. 1.
Figure 6:
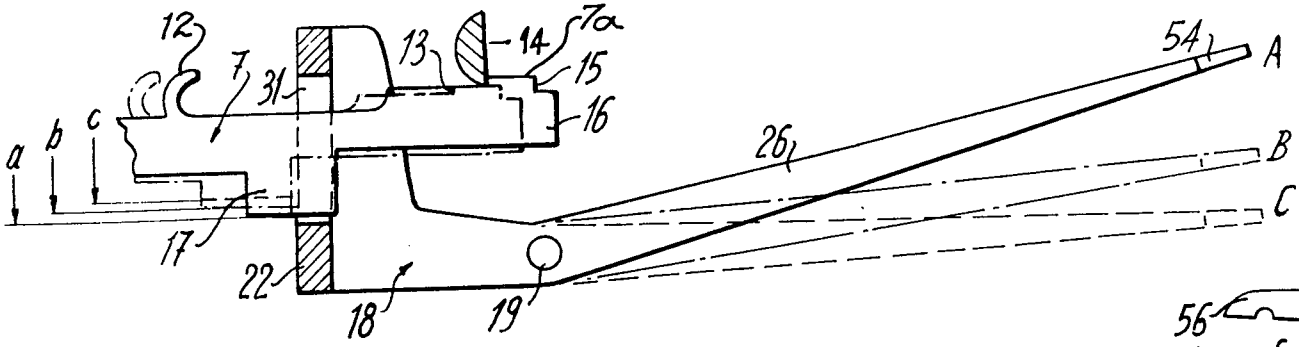

The web 22 of selector lever 18 has three parallel elongated slots 31 arranged to each receive the front part of one of bars 7 (see FIGS. 4 and 6). Also, on this web 22 is secured an inverted L-shaped piece 32 whose horizontal arm 33 extends over the upper parts of the three slots 31 and is capable of bearing on bars 7.

Figure 2:
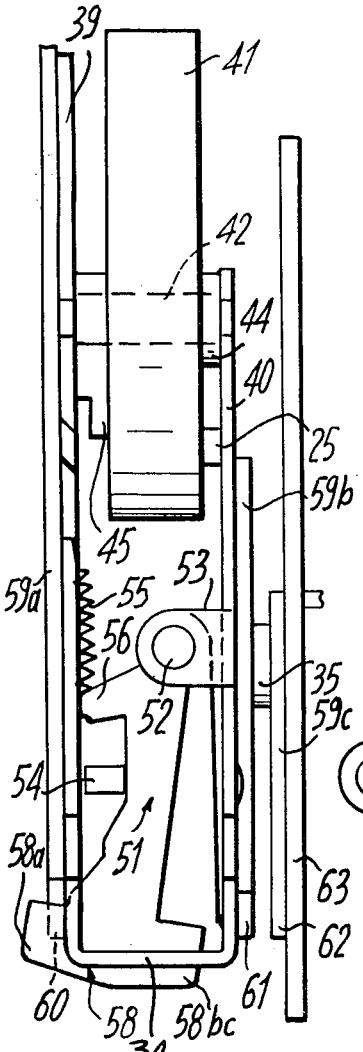
FIG. 2 is a view along line II—II of FIG. 1.
Figure 3:
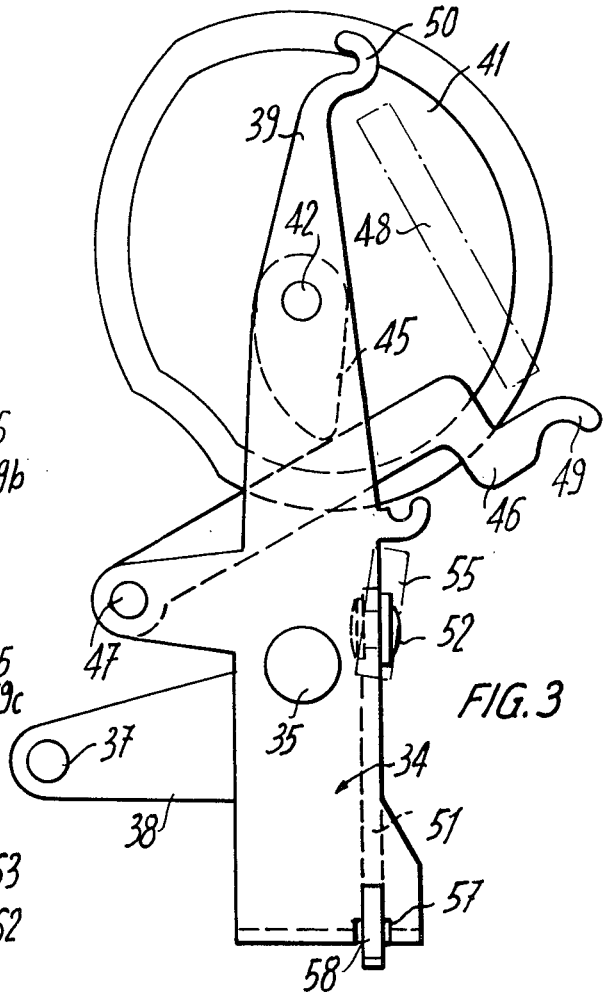
FIG. 3 is an enlarged-scale view of a part of the mechanism of FIG. 1.

Referring particular to FIGS. 1–3 the mechanism also comprises an actuating lever 34 pivotally mounted about a rod 35 fixed to a plate 63 of the frame and acted on by a spring 36 biasing it in the counterclockwise direction. One end of spring 36 is fixed to a pin 37 on a generally horizontal arm 38 of lever 34 and its other end is fixed to the frame. As shown in FIG. 2, lever 34 has in front elevation a U-shape with unequal arms 39 and 40 disposed about a control cam 41 rotatable about a transverse rod 42 rivetted on the two arms 39 and 40. Cam 41 can be driven by a rubber roller 43 which itself is continuously rotated by a motor, not shown.

Cam 41 is provided on one of its faces with an integral locking finger 44 which also rotates about rod 42. Finger 44 is able to cooperate with the end of the upper arm 25 of selector lever 18. Cam 41 is provided on its other face with an integral actuating finger 45 also having the rod 42 as common axis. This finger 45 is able to bear against an arm 46 pivotally mounted at 47 on the actuating lever 34 (see FIG. 3). Arm 46 is biased towards finger 45 by a spring 48 fixed between a hook 49 of arm 46 and a hooked end 50 of arm 39 of lever 34.

Between the arms 39 and 40 of lever 34 is also disposed a selector 51 able to turn transversely in relation to the planes of arms 39 and 40 about a pivot 52 fixed on a bracket 53 perpendicular to arm 40. This selector 51 comprises a member in the shape of an inverted T whose central part has three ramps $S_a$, $S_b$, $S_c$ (FIG. 7) inclined at different angles and each able to cooperate with the end 54 of the lower arm 26 of selector lever 18. A spring 55 acting between arm 39 of lever 34 and an arm 56 of selector 51, biases selector 51 around pivot 52 in the clockwise direction.

Lever 34 also has, at its lower part, a guide slot 57 receiving the lower generally horizontal part 58 of the inverted T of selector 51. This part 58 projects from the base of the U of lever 34 and, depending on the position of selector 51, ends $58_a$ and $58_{bc}$ of part 58 may protrude from the planes of arms 39, 40 respectively. In the rest position shown in FIG. 2, the end 58*a* protrudes from the plane of arm 39 of lever 34.

A first control lever $59_a$, disposed against the outer face of arm 39, is pivotally mounted about the rod 35. This lever $59_a$ controls, by means of a known mechanism, not shown, the step-by-step return of the carriage. Lever $59_a$ has, at its lower part, a notch 60 forming an abutment able to cooperate with the end $58_a$ of selector 51. The lever $59_a$ is normally biased into a rest position in abutment with a stop 70 by a spring 71.

A second control lever $59_b$, bearing against the outer face of arm 40, is pivotally mounted around the rod 35 on plate 63 of the frame. Lever $59_b$, which controls the line spacing by means of a known mechanism, not shown, has, at its lower part, a notch 61 forming an abutment able to cooperate with the end $58_{bc}$ of selector 51.

A third control lever $59_c$ is also pivotally mounted around the rod 35, and is disposed against the face of plate 63 in the proximity of the second lever $59_b$. Lever $59_c$, which controls rapid return of the carriage by means of a known mechanism, not shown, also has a notch 62 forming an abutment able to cooperate with the end $58_{bc}$ of selector 51.

The described mechanism operates as follows:

When the key 2 of one of the three levers 1 is pressed down, the actuated lever 1 pivots about rod 3 and, by means of its intermediate lever 5, causes one of the three bars 7 to slide in the direction of arrow $f_1$, against the action of spring 11. The front face 16 of the actuated bar 7 comes to bear on the abutment face 30 of catch 24 so as to free the selector lever 18 by disengaging beak 23 from catch 24. The lever 18 tends to pivot about rod 19 in the clockwise direction under the action of spring 28. However, before the lever 18 is completely freed, the step 13 of bar 7 engages, under the action of spring 11, with the plane face of the semi-cylindrical stop 14, to thereby lock the bar 7 (see FIG. 5).

The protuberance 17 of the selected bar 7 is thus engaged in one of the three slots 31 in web 22 of lever 18. The lever 18 latter, after complete disengagement of beak 23 from catch 24, pivots in the clockwise direction around rod 19 under the action of spring 28 until it abuts against the selected protuberance 17 on bar 7. During this pivoting of lever 18, the end of the upper arm 25 of lever 18 moves out of engagement with the locking finger 44 on cam 41 and cam 41 is freed. The arcuate notched part of cam 41 is brought into contact with the driving roller 43 by means of arm 46 which moves finger 45 under the action of spring 48. The cam 41 is then driven in the direction of arrow $f_2$ by roller 43. By its raising profile, cam 41 pivots actuating lever 34, together with the selector 51, about rod 35.

Figure 7:
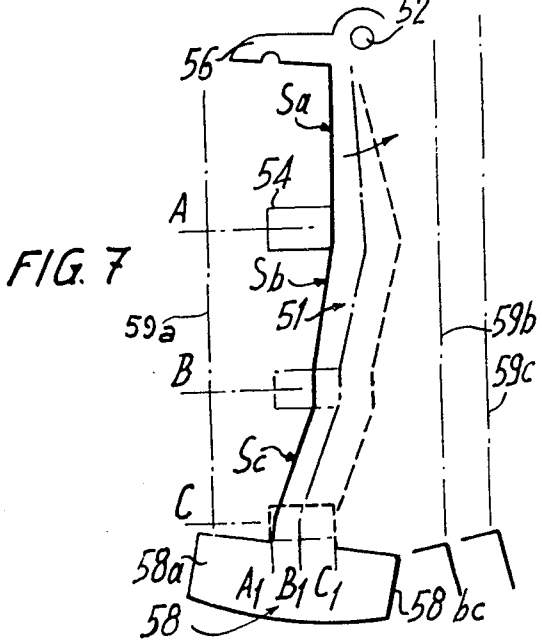
FIGS. 6 and 7 are diagramatic views illustrating the operation of the selection mechanism.

Also, during pivoting of the selector lever 18, the end 54 of the lower arm 26 is placed, as shown in FIGS. 6 and 7, in front of the selector 51 in one of positions A, B and C corresponding respectively to the different heights *a*, *b* and *c* of protuberances 17.

In FIG. 7, for the sake of clarity, the control levers $59_a$, $59_b$ and $59_c$ are indicated in dot-dash lines.

In position A, the end 54 of arm 26 bears against the ramp $S_a$ of selector 51. Consequently, selector 51 does not pivot but remains in its rest position $A_1$ so that the end $58_a$ of the selector 51 protrudes from the plane of arm 39. In this manner, upon pivoting of the lever 34 together with the selector 51, the selector 51 tilts the first control lever $59_a$ which actuates the step-by-step return of the carriage.

In moving to position B, the end 54 slides along ramp $S_b$ and stops at the planar zone at the lower part of the ramp, which pivotally displaces selector 51 to the right (FIG. 7) by one step to position $B_1$. The end $58_{bc}$ of the part 58 thus protrudes from the plane of arm 40, so that upon pivoting of lever 34, it actuates the second lever $59_b$ controlling the line spacing.

In moving to position C, the end 54 slides along ramp $S_c$ and stops against the planar zone at the lower part of the ramp $S_c$, which moves selector 51 to the right (FIG. 7) by two steps to position $C_1$. The end $58_{bc}$ thus protrudes from the plane of arm 40 by a greater amount, so that upon pivoting of lever 34, it drives both the second and third levers $59_b$ and $59_c$ thus simultaneously controlling line spacing and return of the carriage.

It can be seen that with the described mechanism the placing in rotation of a single cam 41 enables the selective control of three functions.

The mechanism is returned to its initial position in the following manner:

As lever 34 pivots to drive one of the control levers $59_a$, $59_b$ or $59_c$, the pin 37 located on arm 38 of lever 34 comes to abut against arm 25. The selector lever 18 is thus made to pivot about rod 19 in the counterclockwise direction, against the direction of spring 28, past its initial position. The result of this additional pivoting of lever 18 is that the arm 33 of piece 32 bears on the bars 7 and pushes them down by an amount sufficient to free bar 7 from stop 14 so that the front face 16 of the selected bar 7 moves out of engagement with the abutment surface 30 of catch 24 which returns to its locking position under the action of biasing spring 29'. Even if the user has not already released the key 2, the catch 24 is free to return to its locking position by surface 30 pivoting into step 15.

At the end of rotation of cam 41, the lever 18 reassumes the position shown in FIG. 1 in which it is held by the catch 24, and the mechanism is ready for a further function-selecting operation.

In order to control repetition of the selected function, the user presses the key 2 down by a greater amount than normal, to advance bar 7 by a supplementary amount so that step 15 is held permanently against the abutment surface 30 of catch 24. The beak 23 is thus held disengaged as long as the key 2 is depressed in, since the downward movement of the bars 7 by arm 33 is insufficient to release abutment surface 30 from step 15. Consequently, the lever 18 repeatedly moves back to its selection position as soon as the pin 37 enables the return of arm 25. The cam 41 can thus continue to turn, causing the pivoting of lever 34 together with selector 51 which controls repetition of the selected function.

I claim:

1. In a typewriter, a mechanism for selectively controlling at least two functions, said mechanism comprising a driving member, a single cam cooperating with said driving member, control levers for each of said functions, an actuating member acting on said control levers, a selector member carried by said actuating member for selectively coupling said actuating member to the control lever of the selected function, a single lever providing means for placing said cam in driving contact with said driving member and for positioning said selector member, and means for selectively acting on said lever to select each of said functions.

2. Mechanism according to claim 1, in which said means for selectively acting on said lever comprises a bar for each function, each bar having a protuberance of given dimensions defining one of said functions, said protuberances cooperating with said lever to position said lever according to the function selected.

3. Mechanism according to claim 2, in which said selector comprises a member pivotally mounted on said actuating member in a plane parallel to the pivotal axis of said actuating member, said member including selectively disposed abutments corresponding to said functions, said lever including an arm cooperating with said member to pivot said member, said member also including an end part which is disposed to drive the selected control lever.

4. Mechanism according to claim 3, in which said member is of inverted T-shape the vertical part of which has ramps connecting said abutments and the horizontal part of said member forms said end part.

5. Mechanism according to claim 2, including means for locking said bars, said locking means including a fixed stop which cooperates with a step of each bar.

6. In a typewriter, a selector mechanism comprising a single movably mounted first member; means for moving said first member with an oscillating movement; a piece movably mounted on said first member between a plurality of discrete positions; a plurality of movably mounted second members controlling a plurality of respective functions to be performed, said second members being disposed so as to be selectively actuated by said piece during an oscillation of said first member according to the position of said piece on said first member; and means for selectively positioning said piece on said first member to cooperate with at least one second member.

7. Mechanism according to claim 6, in which said means for selectively positioning said piece comprise a lever movable from a first position to a plurality of discrete second positions corresponding to positions of said piece for actuating selected second members, and further comprising means for locking said first member when said lever is in said first position, and means for returning said lever to said first position at the end of each oscillation of said first member.

8. In a typewriter, means for selectively controlling a plurality of levers, said means comprising an actuating member, means for transmitting movement between the actuating member and said levers, a single cam causing displacement of said actuating member, said means for transmitting movement comprising a single selector member carried by said actuating member and displaceable into a first position in which it transmits movements of said actuating member to one of said levers and in a second position in which it transmits said movement to another of said levers.

9. Means for selectively controlling a plurality of levers according to claim 8 wherein said selector member is displaceable into a third position and said single selector member is movable into three positions in order to connect said actuating member to the first of said levers in its first position, connect said actuating member to the second of said levers in its second position, and simultaneously to connect said actuating member to the second and third lever in its third position.

* * * * *

UNITED STATES PATENT OFFICE
CERTIFICATE OF CORRECTION

PATENT NO. : 3,939,955
DATED : Feb. 24, 1976
INVENTOR(S) : Ulrich Menzi

It is certified that error appears in the above-identified patent and that said Letters Patent are hereby corrected as shown below:

Disregard the view of the drawing appearing on the cover sheet and substitute the view shown on the attached sheet.

Signed and Sealed this
Eighth Day of March 1977

[SEAL]

*Attest:*

RUTH C. MASON
*Attesting Officer*

C. MARSHALL DANN
*Commissioner of Patents and Trademarks*

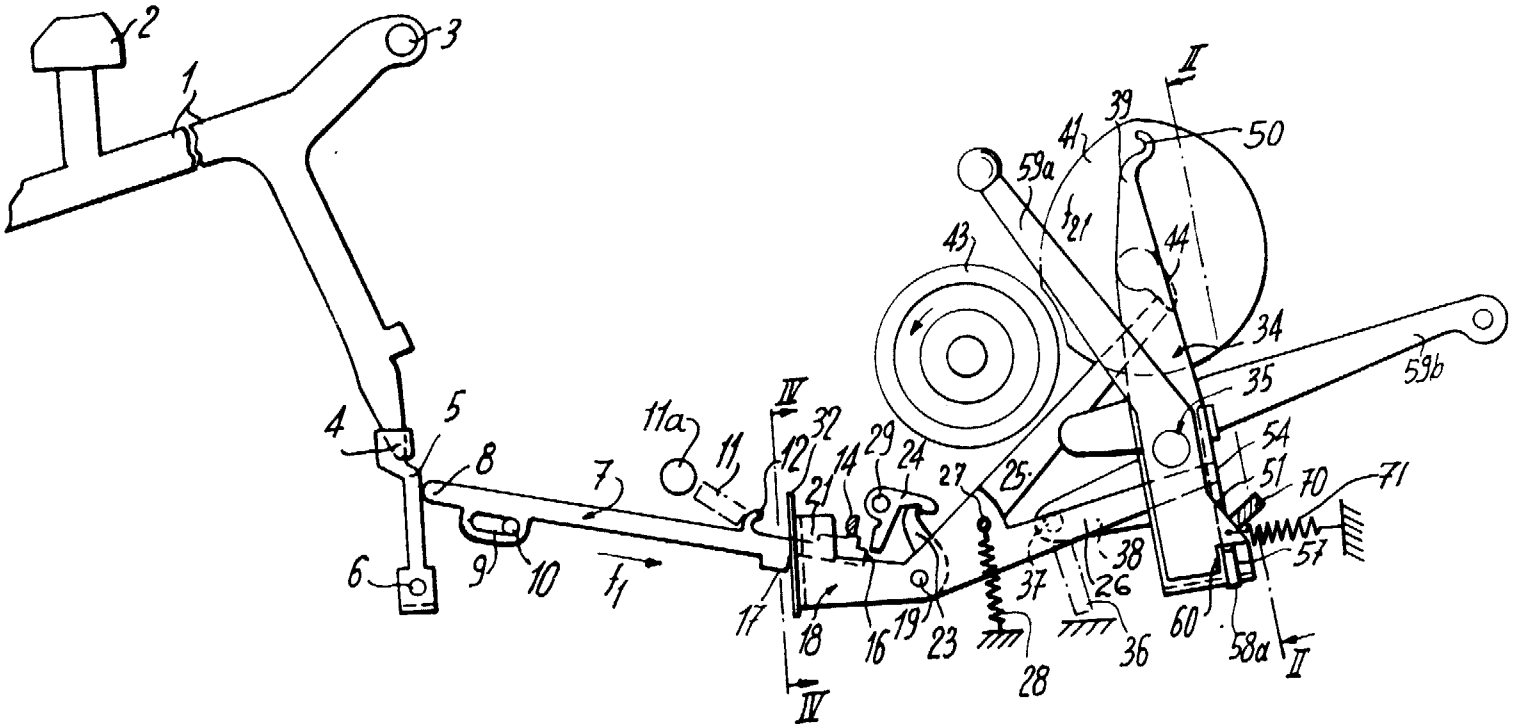

Patent No. 3,939,955